US006296935B1

(12) United States Patent
Higashiura et al.

(10) Patent No.: US 6,296,935 B1
(45) Date of Patent: Oct. 2, 2001

(54) MULTILAYER INSULATED WIRE AND TRANSFORMER USING THE SAME

(75) Inventors: Atsushi Higashiura; Isamu Kobayashi; Naoyuki Chida, all of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 08/914,650

(22) Filed: Aug. 19, 1997

(30) Foreign Application Priority Data

Aug. 22, 1996 (JP) ..... 8-221158

(51) Int. Cl.[7] ..... D02G 3/00

(52) U.S. Cl. ..... 428/373; 428/375; 428/378; 428/398; 428/412; 428/474.4; 174/120 R; 174/120 SR; 174/110 SR; 174/110 N

(58) Field of Search ..... 428/373, 378, 428/398, 375, 401, 412, 473.5; 174/120 R, 120 SR, 110 SR, 110 N

(56) References Cited

U.S. PATENT DOCUMENTS

| | | | | |
|---|---|---|---|---|
| 4,435,350 | * | 3/1984 | Fukushima et al. | 264/280 |
| 5,198,137 | * | 3/1993 | Rutz et al. | 252/62.54 |
| 5,543,174 | * | 8/1996 | Rutz | 427/213 |
| 5,606,152 | | 2/1997 | Higashiura et al. | 174/120 R |
| 5,637,402 | * | 6/1997 | Gay | 428/403 |

FOREIGN PATENT DOCUMENTS

| | | | | |
|---|---|---|---|---|
| 103487 | * | 3/1984 | (EP) | H01B/3/30 |
| 825623 | * | 2/1998 | (EP) | H01F/27/32 |
| 898286 | * | 2/1999 | (EP) | H01B/3/42 |
| 356112U | | 5/1991 | (JP) . | |
| WO 84/04752A1 | | 12/1984 | (WO) . | |
| WO 89/00756 | * | 1/1989 | (WO) | H01B/3/30 |
| WO 94/10693 | * | 5/1994 | (WO) | H01F/1/28 |

* cited by examiner

*Primary Examiner*—Bruce H. Hess
*Assistant Examiner*—B. Shewareged
(74) *Attorney, Agent, or Firm*—Birch, Stewart, Kolasch & Birch, LLP

(57) ABSTRACT

There is disclosed a multilayer insulated wire comprising a conductor and solderable extrusion-insulating layers made up of two or more layers for covering the conductor, wherein at least one insulating layer is formed by a resin mixture comprising 100 parts by weight of a resin (A), of at least one selected from polyetherimide resins and polyethersulfone resins, and 10 parts by weight or more of a resin (B), of at least one selected from polycarbonate resins, polyarylate resins, polyester resins, and polyamide resins. There is also disclosed a transformer using the multilayer insulated wire. The multilayer insulated wire is excellent in heat resistance, solderability, and coilability, and is favorably suitable for industrial production. The transformer is excellent in electrical properties and high in reliability.

14 Claims, 2 Drawing Sheets

MULTILAYER INSULATED WIRE AND TRANSFORMER USING THE SAME

FIELD OF THE INVENTION

The present invention relates to a multilayer insulated wire whose insulating layers are composed of two or more extrusion-coating layers. The present invention also relates to a transformer in which the said multilayer insulated wire is utilized. More specifically, the present invention relates to a multilayer insulated wire that is useful as a winding and a lead wire of a transformer incorporated, for example, in electrical and electronic equipment; the said wire is excellent in heat resistance, and it has such excellent solderability that, when the said wire is dipped in a solder bath, the insulating layer can be removed in a short period of time, to allow the solder to adhere easily to the conductor. The present invention also relates to a transformer that utilizes said multilayer insulated wire.

BACKGROUND OF THE INVENTION

The construction of a transformer is prescribed by IEC (International Electrotechnical Communication) standards Pub. 950, etc. That is, these standards provide that at least three insulating layers be formed between primary and secondary windings, in which an enamel film which covers a conductor of a winding be not authorized as an insulating layer, or that the thickness of an insulating layer be 0.4 mm or more. The standards also provide that the creeping distance between the primary and secondary windings, which varies depending on the applied voltage, be 5 mm or more, that the transformer withstand a voltage of 3,000 V applied between the primary and secondary sides for a minute or more, and the like.

According to such the standards, as a currently prevailing transformer has a construction such as the one illustrated in a cross-section of FIG. 2. Referring to FIG. 2, a flanged bobbin 2 is fitted on a ferrite core 1, and an enameled primary winding 4 is wound around the bobbin 2 in a manner such that insulating barriers 3 for securing the creeping distance are arranged individually on the opposite sides of the peripheral surface of the bobbin. An insulating tape 5 is wound for at least three turns on the primary winding 4, additional insulating barriers 3 for securing the creeping distance are arranged on the insulating tape, and an enameled secondary winding 6 is then wound around the insulating tape.

Recently, a transformer having a construction which includes neither the insulating barriers 3 nor the insulating tape 5, as shown in FIG. 1, has started to be used in place of the transformer having the construction shown in the cross-section of FIG. 2. The transformer shown in FIG. 1 has an advantage over the one having the construction shown in FIG. 2 in being able to be reduced in overall size and dispense with the winding operation for the insulating tape.

In manufacturing the transformer shown in FIG. 1, it is necessary, in consideration of the aforesaid IEC standards, that at least three insulating layers 4*b* (6*b*), 4*c* (6*d*), and 4*d* (6*d*) are formed on the outer peripheral surface on one or both of conductors 4*a* (6*a*) of primary and secondary windings 4 and 6 used.

As such a winding, a winding in which an insulating tape is first wound around a conductor to form a first insulating layer thereon, and is further wound to form second and third insulating layers in succession, so as to form three insulating layers that are separable from one another, is known. Further, a winding in which a conductor enameled with polyurethane is successively extrusion-coated with fluoroplastics, whereby extrusion-coating layers composed of three layers structure are formed for use as insulating layers, is known (Japanese Utility Model application (JU-A) No. 3-56112).

In the above-mentioned case of winding an insulating tape, however, because winding the tape is an unavoidable operation, the efficiency of production is extremely low, and thus the cost of the electrical wire is conspicuously increased.

In the above-mentioned case of extrusion of a fluororesin, since the insulating layer is made of the fluororesin, there is the advantage of good heat resistance. On the other hand, because of the high cost of the resin and the property that when it is pulled at a high shearing speed, the appearance is deteriorated, it is difficult to increase the production speed, and like the insulating tape, the cost of the wire becomes high. Further, in this case of the insulating layer, there is a problem that, since the insulating layer cannot be removed by dipping in a solder bath, the insulating layer on the terminal has to be removed using less reliable mechanical means, and further the wire must be soldered or solderless-connected, when the terminal is worked for the insulated wire to be connected, for example, to a terminal.

On the other hand, a multilayer insulated wire is put to practical use, wherein multilayer extrusion-insulating layers are formed from a mixture of a polyethylene terephthalate as a base resin with an ionomer prepared by converting part of carboxyl groups of an ethylene/methacrylic acid copolymer to metal salts, and wherein the uppermost covering layer of the insulating layers is made of a nylon. This multilayer insulated wire is excellent in cost of electrical wire (nonexpensive materials and high producibility), solderability (to make possible direct connection between an insulated wire and a terminal), and coilability (that means that, in winding the insulated wire around a bobbin, the insulating layer is not broken to damage the electrical properties of the coil, when, for example, parts of the insulated wire are rubbed with each other or the insulated wire is rubbed with a guide nozzle)(U.S. Pat. No. 5,606,152, and JP-A-6-223634 ("JP-A" means unexamined published Japanese patent application)).

Further, to improve heat resistance, the inventors proposed an insulated wire whose base resin is changed from the above polyethylene terephthalate to polycyclohexanedimethylene terephthalate (PCT).

However, although the heat resistance of these multilayer insulated wires is acceptable to heat-resistance Class E in the test method in conformity to Annex U (Insulated wires) of Item 2.9.4.4 and Annex C (Transformers) of Item 1.5.3 of the IEC 950-standards, it nonetheless cannot meet the increased level of heat resistance demanded in recent years, and it is not acceptable to heat-resistance Class B of the IEC standards.

SUMMARY OF THE INVENTION

To solve such problems, an object of the present invention is to provide a multilayer insulated wire that is excellent in heat resistance, solderability, and coilability, and that is favorably suitable for industrial production.

Another object of the present invention is to provide a transformer excellent in electrical properties and high in reliability, wherein such an insulated wire excellent in heat resistance, solderability, and coilability is wound.

Other and further objects, features, and advantages of the invention will appear more fully from the following description, taken in connection with the accompanying drawings.

DETAILED DESCRIPTION OF THE INVENTION

Figure 1:
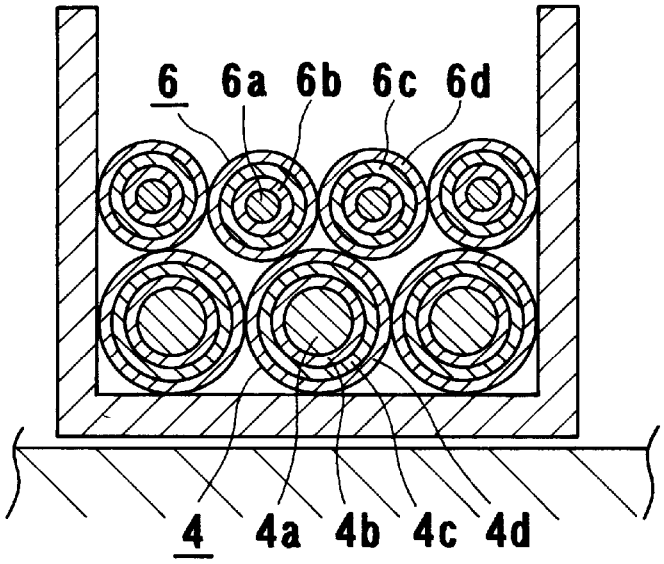
FIG. 1 is a cross-sectional view illustrating an example of the transformer having a structure in which three-layer insulated wires are used as windings.

The above objects of the present invention have been attained by the following multilayer insulated wire and the following transformer in which the said wire is used.

That is, the present invention provides:

(1) A multilayer insulated wire comprising a conductor and solderable extrusion-insulating layers made up of two or more layers for covering the said conductor, wherein at least one insulating layer is formed by a resin mixture comprising 100 parts by weight of a resin (A), of at least one selected from polyetherimide resins and polyethersulfone resins, and 10 parts by weight or more of a resin (B), of at least one selected from polycarbonate resins, polyarylate resins, polyester resins, and polyamide resins.

(2) The multilayer insulated wire as stated in the above (1), wherein the said resin (A) is a polyethersulfone resin.

(3) The multilayer insulated wire as stated in the above (1), wherein the said resin (B) is a polycarbonate resin.

(4) The multilayer insulated wire as stated in the above (1), wherein the said resin (A) is a polyethersulfone resin and the said resin (B) is a polycarbonate resin.

(5) The multilayer insulated wire as stated in the above (1), (2), (3), or (4), wherein the said resin (A) is a polyethersulfone resin having a repeating unit represented by the following formula:

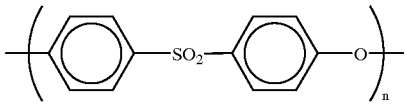

wherein n is a positive integer.

(6) The multilayer insulated wire as stated in one of the above (1) to (5), wherein the said resin mixture comprises 100 parts by weight of the resin (A) and 10 to 70 parts by weight of the resin (B). (7) The multilayer insulated wire as stated in one of the above (1) to (6), wherein the said insulating layers are formed to cover the conductor with the conductor preheated to a temperature lower than 140° C. or not preheated.

(8) The multilayer insulated wire as stated in one of the above (1) to (7), wherein insulating layers other than the said at least one insulating layer are made of a thermoplastic polyester resin or a polyamide resin.

(9) The multilayer insulated wire as stated in one of the above (1) to (8), wherein the uppermost layer of the said insulating layers is made of a polyamide resin.

(10) A transformer, wherein the multilayer insulated wire as stated in one of the above (1) to (9) is used.

In the multilayer insulated wire of the present invention, the insulating layers are made up of two or more layers, preferably three layers. Out of these insulating layers, at least one layer is made of a mixture of the above resins (A) and (B). If importance is attached to heat resistance, preferably all the layers are made of this mixture. On the other hand, if importance is attached to coilability, preferably the uppermost layer of the insulating layers is formed by a layer made of a resin good in lubricity, and layers other than the uppermost layer are layers made of the mixture of the resins (A) and (B).

The said resin (A) is a resin high in heat resistance, and as this resin, polyethersulfone resins can be selected from known polyethersulfone resins for use.

The polyethersulfone resins to be used are preferably these represented by the following formula (1):

formula (1)

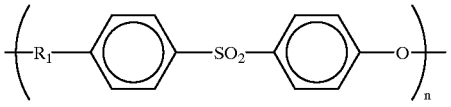

wherein $R_1$ represents a single bond or —$R_2$—O—, in which $R_2$, which may be substituted, represents a phenylene group, a biphenylylene group, or

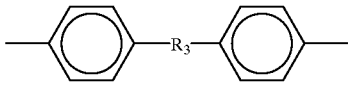

in which $R_3$ represents an alkylene group, such as —C—$(CH_3)_2$— and —$CH_2$—, and n is a positive integer large enough to give the polymer.

The method of producing these resins is known per se, and as an example, a manufacturing method in which a dichlorodiphenyl sulfone, bisphenol S, and potassium carbonate are reacted in a high-boiling solvent, can be mentioned. As commercially available resins, for example, Victrex PES (trade name, manufactured by Sumitomo Chemical Co., Ltd.) and Radel A·Radel R·UDEL (trade names, manufactured by Amoco) can be mentioned.

Further, as the resin (A), polyetherimide resins can be used. The polyetherimide resins, as well as the methods of producing the polyetherimide resins, are known, and, for example, the polyetherimide resins can be synthesized by solution polycondensation of 2,2'-bis[3-(3,4-dicarboxyphenoxy)-phenyl]propanediacid anhydride and 4,4'-diaminodiphenylmethane in ortho-dichlorobenzene as a solvent.

The polyetherimide resins are preferably represented by formula (2):

formula (2)

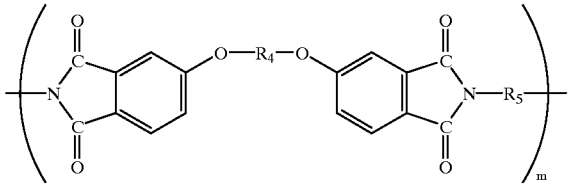

wherein $R_4$ and $R_5$ each represent a phenylene group, a biphenylylene group,

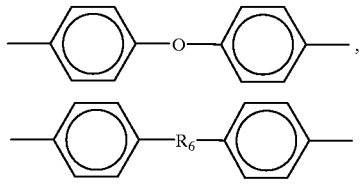

in which $R_6$ represents an alkylene group preferably having 1 to 7 carbon atoms (such as preferably methylene, ethylene, and propylene (particularly preferably isopropylidene)), or a naphthylene group, each of which $R_4$ and $R_5$ may have a substituent, such as an alkyl group (e.g. methyl and ethyl); and m is a positive integer large enough to give the polymer.

As commercially available resins, for example, ULTEM (trade name, manufactured by GE Plastics Ltd.) can be mentioned.

In the present invention, by mixing the heat-resistant resin (A) with the resin (B), the resin composition is given solderability.

The above-mentioned polycarbonate resins, polyarylate resins, polyester resins, and polyamide resins used as the resin (B) are not particularly restricted. As the polycarbonate resins, use can be made of those produced by a known method using, for example, dihydric alcohols, phosgene, etc., as raw materials. As commercially available resins, Lexan (trade name, manufactured by GE Plastics Ltd.), Panlite (trade name, manufactured by Teijin Chemicals Ltd.), and Upiron (trade name, manufactured by Mitsubishi Gas Chemical Co., Inc.) can be mentioned. As the polycarbonate resins for use in the present invention, known polycarbonate resins can be used, such as those represented by formula (3):

formula (3)

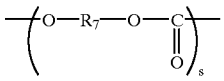

wherein $R_7$ represents a phenylene group, a biphenylylene group,

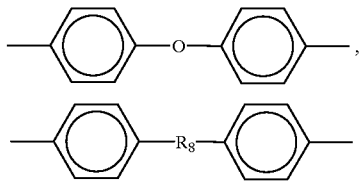

in which $R_8$ represents an alkylene group preferably having 1 to 7 carbon atoms (such as preferably methylene, ethylene, or propylene (particularly preferably isopropylidene)), or a naphthylene group, each of which may have a substituent, such as an alkyl group (e.g. methyl and ethyl); and s is a positive integer large enough to give the polymer.

Further, the polyarylate resins are generally produced by the interfacial polymerization method, in which, for example, bisphenol A dissolved in an aqueous alkali solution, and a terephthalic chloride/isophthalic chloride mixture dissolved in an organic solvent, such as a halogenated hydrocarbon, are reacted at normal temperatures, to synthesize the resin. As commercially available resins, for example, U-polymer (trade name, manufactured by Unitika Ltd.) can be mentioned.

Further, as the polyester resins, those produced by a known method using, as raw materials, dihydric alcohols, divalent aromatic carboxylic acids, etc., can be used. As commercially available resins, use can be made of polyethylene terephthalate (PET)-series resins, such as Byropet (trade name, manufactured by Toyebo Co., Ltd.), Bellpet (trade name, manufactured by Kanebo, Ltd.), and Teijin PET (trade name, manufactured by Teijin Ltd.); polyethylene naphthalate (PEN)-series resins, such as Teijin PEN (trade name, manufactured by Teijin Ltd.); and polycyclohexanedimethylene terephthalate (PCT)-series resins, such as EKTAR (trade name, manufactured by Toray Industries, Inc.).

Further, as the polyamide resins, those produced by a known method using, as raw materials, diamines, dicarboxylic acids, etc., can be used. As commercially available resins, for example, nylon 6,6, such as Amilan (trade name, manufactured by Toray Industries, Inc.), Zytel (trade name, manufactured by E. I. du Pont De Nemours & Co., Inc.), Maranyl (trade name, manufactured by Unitika Ltd.); nylon 4,6, such as Unitika Nylon 46 (trade name, manufactured by Unitika Ltd.); and nylon 6,T, such as ARLEN (trade name, manufactured by Mitsui Petrochemical Industries, Ltd.), can be mentioned.

Further, in the present invention, as to the resin (B), for example, polycarbonate resins, polyarylate resins, polyester resins, and polyamide resins, which is to be mixed with the resin (A) that has heat resistance, part of this resin (B) is expected to be decomposed to produce components exhibiting flux action (e.g. carboxylic acids, amines, alcohols, and aldehydes) when the resin is mixed (kneaded) with the heat resistant resin (A), or when the insulated wire is soldered.

In the present invention, the amount of the resin (B) to be mixed to 100 parts by weight of the resin (A) is 10 parts by weight or more. When the amount of the resin (B) to be mixed with the resin (A) is too small, heat resistance is increased but solderability cannot be obtained. The upper limit of the amount of the resin (B) to be mixed is determined taking the level of the required heat resistance into account, and it is preferably 100 parts by weight or less. When a particularly high level of heat resistance is to be realized while keeping high solderability, the amount of the resin (B) to be mixed is preferably 70 parts by weight or less, and a preferable range wherein both of these properties are particularly well balanced is that the amount of the resin (B) to be mixed is 20 to 50 parts by weight, to 100 parts by weight of the resin (A).

In the present invention, it is particularly noticeable that polyetherimide resins and polyethersulfone resins that are heat-resistance resins do not show any solderability at all, and the solderability of polycarbonate resins and polyarylate resins is not on a practical level, and, only when both the resins ((A) and (B)) are blended, can the solderability be improved to a practical level. Although polyester resins and polyamide resins exhibit good solderability, when respectively used singly, it is surprising that practical solderability can be exhibited even upon mixing them at a low rate.

The above resin mixture can be prepared by melting and mixing by using a usual mixer, such as a twin-screw extruder, a kneader, and a co-kneader. It has been found that the mixing temperature of the resins to be mixed has an influence on the direct solderability, and the higher the mixing temperature of the mixer is set at, the better the resulting direct solderability is. Preferably the mixing temperature is set at 320° C. or higher, and particularly preferably 360° C. or higher.

To the above resin mixture can be added other heat-resistant thermoplastic resins, in such amounts that they do not impair the direct solderability and heat resistance. The heat-resistant thermoplastic resins that can be added are preferably ones that themselves are good in solderability, such as a polyurethane resin and a polyacryl resin.

To the above resin mixture can be added additives, inorganic fillers, processing aids, and coloring agents, each of which are usually used, in such amounts that they do not impair the direct solderability and the heat resistance.

Further, preferably two or more layers of the resin mixture for the constitution of the insulating layers of the multilayer insulated wire, are used in combination for the extrusion coating, because in that case the balance between the assurance of heat resistance and solderability is good.

As thermoplastic resins having solderability and capability of forming an insulating layer, besides the above resin mixture, resins whose major component is a polyamide, and resins whose major component is a polyester, can be used, and specific examples of polyamide resins that can be used are nylon 12, nylon 6, nylon 6,6, and nylon 4,6.

In particular, to make the heat resistance and solderability balance, preferably nylon 6,6 or nylon 4,6 is used, and most preferably they are used to form the uppermost layer, in consideration of the coilability of the resulting insulated wire.

Further, as the polyester resins, those made from aromatic dicarboxylic acids and aliphatic diols, such as polybutylene terephthalates (PBT), polyethylene terephthalates (PET), polycyclohexanedimethane terephthalates (PCT), and polyethylene naphthalates (PEN), can be used.

Further, other resins, additives, etc., may be blended and added to the above resin mixture or resins whose major components are said polyamide-series resins and/or polyester-series resins, unless they adversely affect the heat resistance and solderability.

Further, when the resin mixture is applied to a conductor by extrusion coating, the solderability is improved greatly if the conductor is not preliminary heated (preheated). When the conductor is preliminarily heated, preferably the temperature is set to 140° C. or below.

That is, the weakening of the adhesion between the conductor and the resin mixture coating layer due to not heating the conductor, together with a large heat shrinkage of 10 to 30% of the resin mixture coating layer in the direction of the wire length at the time of soldering, improves the solderability.

As the conductor for use in the present invention, a metal bare wire (solid wire), an insulated wire having an enamel film or a thin insulating layer coated on a metal bare wire, a multicore stranded wire (a bunch of wires) composed of twisted metal bare wires, or a multicore stranded wire composed of twisted insulated-wires that each have an enamel film or a thin insulating layer coated, can be used. The number of the twisted wires of the multicore stranded wire can be chosen arbitrarily depending on the desired high-frequency application. Alternatively, when the number of wires of a multicore wire is large, for example, in a 19- or 37-element wire, the multicore wire (elemental wire) may be in a form of a stranded wire or a non-stranded wire. In the non-stranded wire, for example, multiple conductors that each may be a bare wire or an insulated wire to form the element wire, may be merely gathered (collected) together to bundle up them in an approximately parallel direction, or the bundle of them may be twisted in a very large pitch. In each case of these, the cross-section thereof is preferably a circle or an approximate circle. However, it is required that, as the material of the thin insulating layer, a resin that is itself good in solderability, such as an esterimide-modified polyurethane resin, a urea-modified polyurethane resin, and a polyesterimide resin, be used, and specifically, for example, WD-4305 (trade name, manufactured by Hitachi Chemical Co., Ltd.), TSF-200 and TPU-7000 (trade names, manufactured by Totoku Toryo Co.), and Fs-304 (trade name, manufactured by Dainichi Seika Co.) can be used. Further, application of solder to the conductor or plating of the conductor with tin is a means of improving the solderability.

In a preferable embodiment of the present invention, the heat-resistant multilayer insulated wire is produced by extrusion-coating a resin or a resin mixture for a first layer onto a peripheral surface of a conductor to form a first insulating layer with a prescribed thickness, then extrusion-coating a resin or a resin mixture for a second layer onto the outer surface of the first insulating layer to form a second insulating layer with a prescribed thickness, and then extrusion-coating a resin or a resin mixture for a third layer onto the outer peripheral surface of the second insulating layer to form a third insulating layer with a prescribed thickness. Preferably, in the case of three layers, the overall thickness of the extrusion-coating insulating layers thus formed is controlled within the range of 60 to 180 $\mu$m. This is because the electrical properties of the resulting heat-resistant multilayer insulated wire are greatly lowered to make the wire impractical if the overall thickness of the insulating layers is too small. On the other hand, the solderability is deteriorated considerably if the overall thickness of the insulating layers is too large. More preferably the overall thickness of the extrusion-coating insulating layers is in the range of 70 to 150 $\mu$m. Preferably, the thickness of each of the above three layers is controlled within the range of 20 to 60 $\mu$m.

In the multilayer insulated wire of the present invention, the insulating layers have at least one layer of the said resin mixture, and the remaining insulating layer may be a layer whose major component is a thermoplastic resin that is solderable, so that both properties of heat resistance and solderability can be satisfied.

The reason for that is not clearly known but is expected as follows. That is, it is important that the resin mixture be made up of at least one resin selected from polyetherimide resins and polyethersulfone resins higher in heat resistance, and at least one resin selected from polycarbonate resins, polyarylate resins, polyester resins, and polyamide resins lower in heat resistance. When they are mixed, part of the resins lower in heat resistance is decomposed thermally, to be lowered in molecular weight, thereby lowering the melt viscosity of the resultant mixture and producing components that exhibit flux action. This is believed to make it possible to cause solderability to be exhibited while keeping high heat resistance in the case of extrusion coating.

Further, when the said resin mixture is formed into the first coating layer, it has been found that, due to the large heat shrinkage the adhesion is lowered without carrying out preliminary heating of the conductor, and therefore the level of solderability can be further improved.

The transformer of the present invention, in which the multilayer insulated wire of the present invention is used, not only satisfies the IEC 950 standards, it is also applicable to severe design, since there is no winding of an insulating tape, such that the transformer can be made small in size and the heat resistance and the high-frequency properties may be high.

Figure 2:
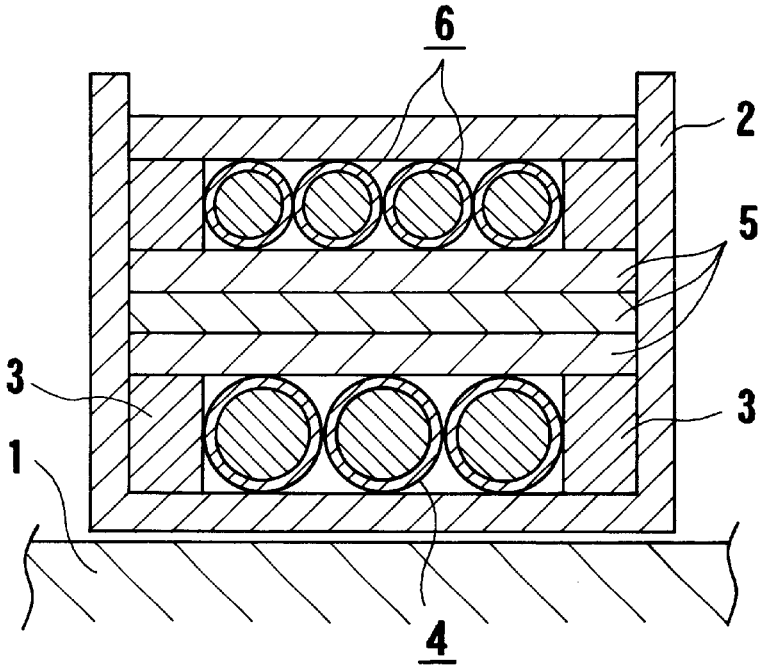
FIG. 2 is a cross-sectional view illustrating an example of the transformer having a conventional structure.

The multilayer insulated wire of the present invention can be used as a winding for any type of transformer, including those shown in FIGS. 1 and 2. In a transformer, generally a primary winding and a secondary winding are wound in a layered manner on a core, but the multilayer insulated wire of the present invention may be applied to a transformer in which a primary winding and a secondary winding are alternatively wound (JP-A-5-152139). In the transformer of the present invention, the above multilayer insulated wire may be used as both primary and secondary windings or as one of primary and secondary windings. Further, when the multilayer insulated wire of the present invention has two layers (for example, when both of a primary winding and a secondary winding are the two-layer insulated wires, or when one of a primary winding and a secondary winding is an enameled wire and the other is the two-layer insulated wire), at least one insulating barrier layer may be interposed between the windings for use.

According to the multilayer insulated wire of the present invention, when the terminal is worked, direct soldering can be carried out, and the level of heat resistance is favorably satisfactory.

The present invention will now be described in more detail with reference to the following examples, but the invention is not limited to them.

EXAMPLE

Examples 1 to 18 and Comparative Examples 1 to 5

As conductors, bare wires (solid wires) of annealed copper wires of diameter 0.4 mm, and stranded wires, each composed of seven twisted cores (insulated wires), each made by coating an annealed copper wire of diameter 0.15 mm with Insulating Varnish WD-4305, manufactured by Hitachi Chemical Co., Ltd., so that the coating thickness of the varnish layer would be 8 μm, were prepared. The conductors were respectively coated successively, by extrusion coating, with resin layers having the formulations (compositions are shown in terms of parts by weight) for extrusion coating and the thicknesses shown in Table 1, thereby preparing multilayer insulated wires (surface treatment: use was made of a refrigerating machine oil).

With respect to the thus-prepared multilayer insulated wires, the properties were measured as follows:

Solderability:

A length of about 40 mm at the end of the insulted wire was dipped in molten solder at a temperature of 450° C., and the time (sec) required for the adhesion of the solder to the dipped 30-mm-long part was measured. The shorter the required time is, the more excellent the solderability is. The numerical value shown was the average value of n=3.

Heat resistance (1):

The heat resistance was evaluated by the following test method, in conformity to Annex U (Insulated wires) of Item 2.9.4.4 and Annex C (Transformers) of Item 1.5.3 of 950-standards of the IEC standards.

Ten turns of the multilayer insulated wire were wound around a mandrel of diameter 6 mm under a load of 118 MPa (12 kg/mm$^2$). They were heated for 1 hour at 225° C. (Class E, 215° C.), and then for additional 72 hours at 175° C. (Class E, 165° C.), and then they were kept in an atmosphere of 25° C. and humidity 95% for 48 hours. Immediately thereafter, a voltage of 3,000 V was applied thereto, for 1 min. When there was no electrical short-circuit, it was considered that it passed Class B. (The judgment was made with n=5. It was considered that it did not pass the test if it was NG even when n=1.)

Coilability (static friction coefficients)

Figure 3:
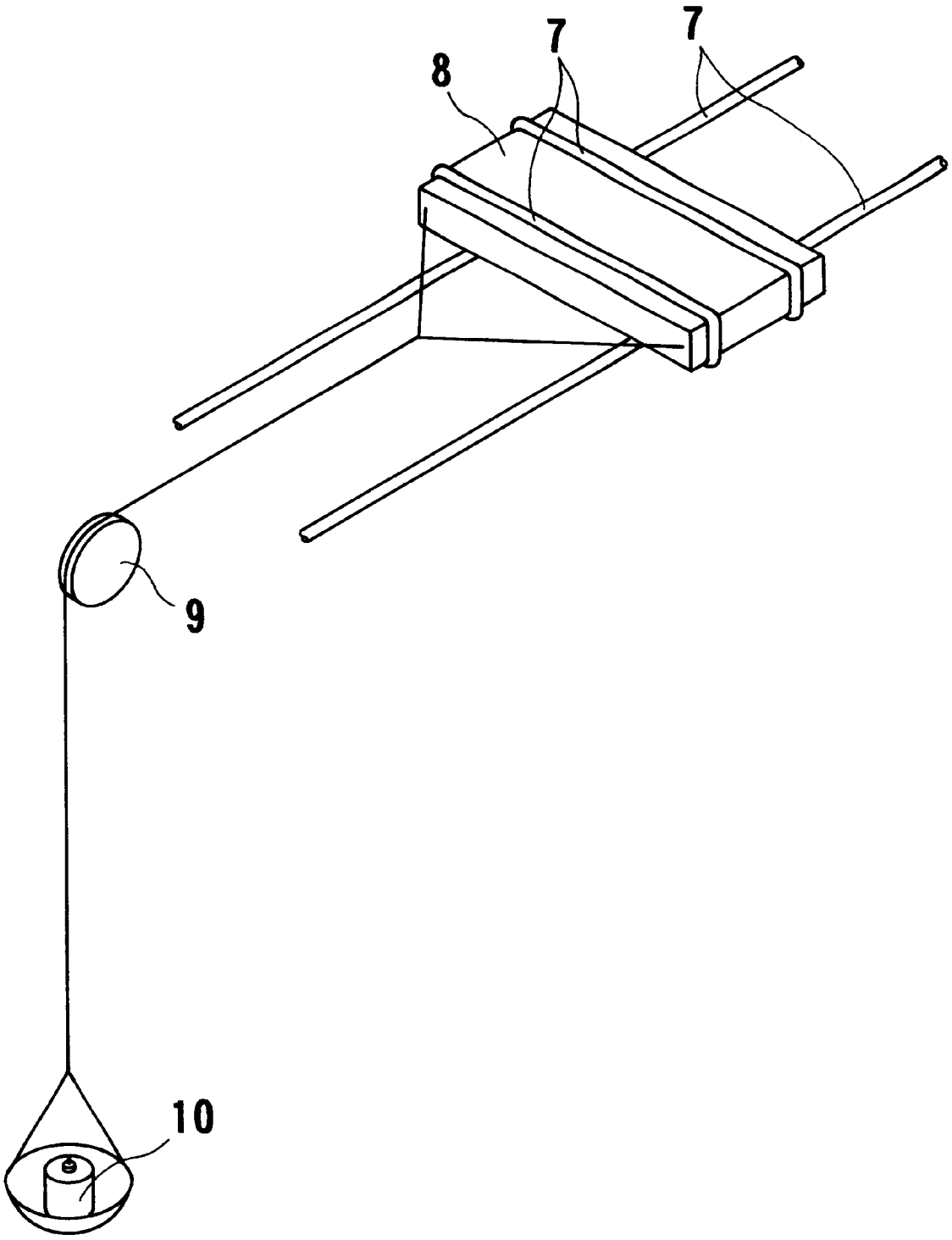
FIG. 3 is a schematic diagram showing a method of measuring static friction coefficients.

The method of measuring static friction coefficients is shown in FIG. 3, wherein 7 indicates multilayer insulated wires, 8 indicates a load plate having a mass of W g, 9 indicates a pulley, and 10 indicates a load. Letting the mass of the load 10 be F g when the load plate 8 starts to move, the static friction coefficient is found from F/W.

The smaller the obtained numerical value is, the better the slipperiness of the surface is and the better the coilability is.

TABLE 1

| | | | Example | | | Comparative Example | |
|---|---|---|---|---|---|---|---|
| | | | 1 | 2 | 3 | 1 | 2 |
| Conductor | | | Bare wire | Bare wire | Bare wire | Bare wire | Bare wire |
| Production speed (m/min) | | | 200 | 200 | 200 | 200 | 200 |
| Preheating temperature(° C.) | | | 200 | 200 | 200 | None | None |
| Kneading temperature (° C.) | | | 360 | 360 | 360 | 360 | 360 |
| First layer | Resin (A) | PEI*1 | 100 | 100 | — | 100 | — |
| | | PES*2 | — | — | 100 | — | 100 |
| | Resin (B) | PAR*3 | — | — | — | — | — |
| | | PC-1*4 | 40 | 20 | — | — | — |
| | | PC-2*5 | — | — | 40 | — | — |
| | | PCT-2*10 | — | — | — | — | — |
| | | PA-1*6 | — | — | — | — | — |
| | PF*8 | | — | — | — | — | — |
| | Coating thickness (μm) | | 30 | 36 | 35 | 30 | 33 |
| Second layer | Resin (A) | PEI*1 | 100 | 100 | — | 100 | — |
| | | PES*2 | — | — | 100 | — | 100 |
| | Resin (B) | PAR*3 | — | — | — | — | — |
| | | PC-1*4 | 40 | 20 | — | — | — |
| | | PC-2*5 | — | — | 40 | — | 40 |
| | | PCT-1*9 | — | — | — | — | — |
| | | PCT-2*10 | — | — | — | — | — |
| | | PA-2*7 | — | — | — | — | — |
| | PF*8 | | — | — | — | — | — |
| | Coating thickness (μm) | | 30 | 30 | 33 | 30 | 33 |
| Third | Resin (A) | PEI*1 | 100 | 100 | — | 100 | — |

TABLE 1-continued

| | | | | | | | |
|---|---|---|---|---|---|---|---|
| layer | | PES*2 | — | — | 100 | — | — |
| | Resin (B) | PC-1*4 | 40 | 20 | — | — | — |
| | | PC-2*5 | — | — | 40 | — | — |
| | | PA-2*7 | — | — | — | — | — |
| | PF*8 | | — | — | — | — | — |
| | PCT-1*9 | | — | — | — | — | — |
| | PA-2*7 | | — | — | — | — | 100 |
| | Coating thickness (μm) | | 30 | 30 | 33 | 30 | 33 |
| Overall coating thickness (μm) | | | 90 | 90 | 100 | 90 | 100 |
| Wire appearance | | | Good | Good | Good | Good | Good |
| Solderability | | | 5.0 | 6.0 | 4.0 | 20 sec≦ NG | 20 sec≦ NG |
| Heat resistance (1)*11: | | Class B | ○ | ○ | ○ | ○ | ○ |
| | | Class E | — | — | — | — | — |
| Static friction coefficient | | | 0.13 | 0.14 | 0.16 | 0.16 | 0.08 |

| | | | Comparative Example | | | Example | |
|---|---|---|---|---|---|---|---|
| | | | 3 | 4 | 5 | 4 | 5 |
| Conductor | | | Bare wire | Bare wire | Bare wire | Bare wire | Bare wire |
| Production speed (m/min) | | | 200 | 50 | 200 | 200 | 200 |
| Preheating temperature(° C.) | | | 200 | 200 | None | 200 | 200 |
| Kneading temperature (° C.) | | | None | None | 360 | 360 | 360 |
| First layer | Resin (A) | PEI*1 | — | — | — | 50 | 100 |
| | | PES*2 | — | — | 100 | 50 | — |
| | Resin (B) | PAR*3 | — | — | — | — | — |
| | | PC-1*4 | 100 | — | — | — | — |
| | | PC-2*5 | — | — | 5 | 20 | 40 |
| | | PCT-2*10 | — | — | — | — | — |
| | | PA-1*6 | — | — | — | 20 | — |
| | PF*8 | | — | 100 | — | — | — |
| | Coating thickness (μm) | | 30 | 30 | 33 | 33 | 30 |
| Second layer | Resin (A) | PEI*1 | — | — | — | 50 | 100 |
| | | PES*2 | — | — | 100 | 50 | — |
| | Resin (B) | PAR*3 | — | — | — | — | — |
| | | PC-1*4 | 100 | — | — | — | 40 |
| | | PC-2*5 | — | — | 5 | 20 | — |
| | | PCT-1*9 | — | — | — | — | — |
| | | PCT-2*10 | — | — | — | — | — |
| | | PA-2*7 | — | — | — | 20 | — |
| | PF*8 | | — | 100 | — | — | — |
| | Coating thickness (μm) | | 30 | 30 | 33 | 33 | 30 |
| Third layer | Resin (A) | PEI*1 | — | — | — | 50 | 100 |
| | | PES*2 | — | — | — | 50 | — |
| | Resin (B) | PC-1*4 | 100 | — | — | — | — |
| | | PC-2*5 | — | — | — | 20 | — |
| | | PA-2*7 | — | — | — | 20 | — |
| | PF*8 | | — | 100 | — | — | — |
| | PCT-1*9 | | — | — | — | — | — |
| | PA-2*7 | | — | 100 | — | — | — |
| | Coating thickness (μm) | | 30 | 30 | 33 | 33 | 30 |
| Overall coating thickness (μm) | | | 90 | 90 | 100 | 100 | 90 |
| Wire appearance | | | Good | Good | Bad | Good | Good |
| Solderability | | | 10.0 | 20 sec≦ NG | 20 sec≦ NG | 3.5 | 4.0 |
| Heat resistance (1)*11: | | Class B | x | ○ | ○ | ○ | ○ |
| | | Class E | x | — | — | — | — |
| Static friction coefficient | | | 0.17 | 0.06 | 0.08 | 0.12 | 0.07 |

| Example | | | | | | | |
|---|---|---|---|---|---|---|---|
| | | | 6 | 7 | 8 | 9 | 10 |
| Conductor | | | Bare wire | Bare wire | Bare wire | Bare wire | Bare wire |
| Production speed (m/min) | | | 200 | 200 | 200 | 200 | 200 |
| Preheating temperature(° C.) | | | 200 | 200 | 200 | 200 | 200 |
| Kneading temperature (° C.) | | | 360 | 360 | 360 | 360 | 360 |
| First layer | Resin (A) | PEI*1 | 100 | 100 | 100 | — | — |
| | | PES*2 | — | — | — | 100 | 100 |
| | Resin (B) | PAR*3 | — | 40 | — | — | — |
| | | PC-1*4 | — | — | — | — | — |
| | | PC-2*5 | 65 | — | — | 15 | 40 |
| | | PCT-2*10 | — | — | 40 | — | — |
| | | PA-1*6 | — | — | — | — | — |
| | PF*8 | — | | — | — | — | — |

TABLE 1-continued

| | | | | | | | |
|---|---|---|---|---|---|---|---|
| | Coating thickness (μm) | | 30 | 33 | 33 | 33 | 33 |
| Second layer | Resin (A) | PEI*1 | 100 | 100 | 100 | — | — |
| | | PES*2 | — | — | — | 100 | 100 |
| | Resin (B) | PAR*3 | — | 40 | — | — | — |
| | | PC-1*4 | 65 | — | — | — | — |
| | | PC-2*5 | — | — | — | 15 | 40 |
| | | PCT-1*9 | — | — | — | — | — |
| | | PCT-2*10 | — | — | — | 40 | — |
| | | PA-2*7 | — | — | — | — | — |
| | PF*8 | | — | — | — | — | — |
| | Coating thickness (μm) | | 30 | 33 | 33 | 33 | 33 |
| Third layer | Resin (A) | PEI*1 | — | — | — | — | — |
| | | PES*2 | — | — | — | — | — |
| | Resin (B) | PC-1*4 | — | — | — | — | — |
| | | PC-2*5 | — | — | — | — | — |
| | | PA-2*7 | — | — | — | — | — |
| | PF*8 | | — | — | — | — | — |
| | PCT-1*9 | | — | — | — | — | — |
| | PA-2*7 | | 100 | 100 | — | 100 | 100 |
| | Coating thickness (μm) | | 30 | 33 | 33 | 33 | 30 |
| Overall coating thickness (μm) | | | 90 | 100 | 100 | 100 | 100 |
| Wire appearance | | | Good | Good | Good | Good | Good |
| Solderability | | | 3.5 | 4.0 | 4.0 | 4.5 | 2.5 |
| Heat resistance (1)*11: | | Class B | ○ | ○ | ○ | ○ | ○ |
| | | Class E | — | — | — | — | — |
| Static friction coefficient | | | 0.07 | 0.09 | 0.11 | 0.08 | 0.07 |

| | | | Example | | | | |
|---|---|---|---|---|---|---|---|
| | | | 11 | 12 | 13 | 14 | 15 |
| Conductor | | | Bare wire | Bare wire | Bare wire | Bare wire | Bare wire |
| Production speed (m/min) | | | 200 | 200 | 200 | 200 | 200 |
| Preheating temperature (° C.) | | | 200 | 200 | 140 | None | 200 |
| Kneading temperature (° C.) | | | 360 | 360 | 360 | 360 | 360 |
| First layer | Resin (A) | PEI*1 | — | 100 | 100 | 100 | 100 |
| | | PES*2 | 100 | — | — | — | — |
| | Resin (B) | PAR*3 | 65 | — | — | — | — |
| | | PC-1*4 | — | — | 40 | 40 | 40 |
| | | PC-2*5 | — | 40 | — | — | — |
| | | PCT-2*10 | — | — | — | — | — |
| | | PA-1*6 | — | — | — | — | — |
| | PF*8 | | — | — | — | — | — |
| | Coating thickness (μm) | | 33 | 36 | 30 | 30 | 66 |
| Second layer | Resin (A) | PEI*1 | — | — | 100 | 100 | 100 |
| | | PES*2 | 100 | — | — | — | — |
| | Resin (B) | PAR*3 | 65 | — | — | — | — |
| | | PC-1*4 | — | 100 | 40 | 40 | 40 |
| | | PC-2*5 | — | — | — | — | — |
| | | PCT-1*9 | — | — | — | — | — |
| | | PCT-2*10 | — | — | — | — | — |
| | | PA-2*7 | — | — | — | — | — |
| | PF*8 | | — | — | — | — | — |
| | Coating thickness (μm) | | 33 | 30 | 30 | 30 | 60 |
| Third layer | Resin (A) | PEI*1 | — | — | — | — | — |
| | | PES*2 | — | — | — | — | — |
| | Resin (B) | PC-1*4 | — | — | — | — | — |
| | | PC-2*5 | — | — | — | — | — |
| | | PA-2*7 | — | — | — | — | — |
| | PF*8 | | — | — | — | — | — |
| | PCT-1*9 | | — | — | — | — | — |
| | PA-2*7 | | 100 | 100 | 100 | 100 | 100 |
| | Coating thickness (μm) | | 33 | 30 | 30 | 30 | 60 |
| Overall coating thickness (μm) | | | 100 | 90 | 90 | 90 | 180 |
| Wire appearance | | | Good | Good | Good | Good | Good |
| Solderability | | | 2.5 | 3.0 | 2.7 | 2.0 | 7.0 |
| Heat resistance (1)*11: | | Class B | ○ | ○ | ○ | ○ | ○ |
| | | Class E | — | — | — | — | — |
| Static friction coefficient | | | 0.09 | 0.08 | 0.07 | 0.08 | 0.07 |

| | Example | | |
|---|---|---|---|
| | 16 | 17 | 18 |
| Conductor | Bare wire | Stranded wire | Stranded wire |
| Production speed (m/min) | 200 | 200 | 200 |
| Preheating temperature (° C.) | 200 | 200 | 200 |
| Kneading temperature (° C.) | 320 | 360 | 360 |

TABLE 1-continued

| | | | | | |
|---|---|---|---|---|---|
| First layer | Resin (A) | PEI*1 | 100 | 100 | — |
| | | PES*2 | — | — | 100 |
| | Resin (B) | PAR*3 | — | — | — |
| | | PC-1*4 | 40 | 40 | 40 |
| | | PC-2*5 | — | — | — |
| | | PCT-2*10 | — | — | — |
| | | PA-1*6 | — | — | — |
| | PF*8 | | — | — | — |
| | Coating thickness (μm) | | 30 | 30 | 33 |
| Second layer | Resin (A) | PEI*1 | 100 | 100 | — |
| | | PES*2 | — | — | 100 |
| | Resin (B) | PAR*3 | — | — | — |
| | | PC-1*4 | 40 | 40 | 40 |
| | | PC-2*5 | — | — | — |
| | | PCT-1*9 | — | — | — |
| | | PCT-2*10 | — | — | — |
| | | PA-2*7 | — | — | — |
| | PF*8 | | — | — | — |
| | Coating thickness (μm) | | 30 | 30 | 33 |
| Third layer | Resin (A) | PEI*1 | — | — | — |
| | | PES*2 | — | — | — |
| | Resin (B) | PC-1*4 | — | — | — |
| | | PC-2*5 | — | — | — |
| | | PA-2*7 | — | — | — |
| | PF*8 | | — | — | — |
| | PCT-1*9 | | — | — | — |
| | PA-2*7 | | 100 | 100 | 100 |
| | Coating thickness (μm) | | 30 | 30 | 33 |
| Overall coating thickness (μm) | | | 90 | 90 | 100 |
| Wire appearance | | | Good | Good | Good |
| Solderability | | | 5.5 | 4.0 | 2.5 |
| Heat resistance (1)*11: | | Class B | ○ | ○ | ○ |
| | | Class E | — | — | — |
| Static friction coefficient | | | 0.08 | 0.09 | 0.08 |

Note:
*1PEI: ULTEM 1000 (trade name, manufactured by GE Plastics Ltd.) Polyetherimide resin
*2PES: Victrex PES 4100G (trade name, manufactured by Suitomo Chemical Co., Ltd.) Polyethersulfone resin
*3PAR: U polymer U-100 (trade name, manufacture by Unitika Ltd..) Polyarylate resin
*4PC-1: Lexan SP-1010 (trade name, manufactured by GE Plastics Ltd.) Polycarbonate resin
*5PC-2: Lexan Sp-1210 (trade name, manufactured by GE Plastics Ltd.) Polycarbonate resin
*6PA-1: ARLEN AE-4200 (trade name, manufacture by Mitsui Petrochemical Industries, Ltd.) Polyamide resin (nylon 6,T)
*7PA-2: F-5001 (trade name, manufactured by Unitika Ltd.) Polyamide resin (nylon 4,6)
*8PF: Teflon 100J (trade name, manufactured by Du Pont-Mitsui Fluorochemicals Co., Ltd.) Fluororesin
*9PCT-1: EKTAR-DA (trade name manufactured by Toray Industries, Inc.) Polycyclohexanedimethylene terephthalate resin
*10PCT-2: EKTAR-676 (trade name, manufacture by Toray Industries, Inc.) Polycyclohexanedimethylene terephthalate resin
*11○: Passed x: Not passed From the results shown in Table 1, the followings are apparent.

Since, in each of Examples 1 to 4, all of the three layers were made of the resin mixture in the range defined in the present invention, Examples 1 to 4 exhibited good solderability and heat resistance.

Each of Examples 5, 6, and 9 to 11 used a polyamide resin in the third layer, and therefore each was good in heat resistance and solderability and had a small static friction coefficient, leading to good coilability. Each of Examples 7 and 8 used a polyester resin, and therefore the coilability was somewhat below that of the case in which a polyamide resin was used, but the balance was good.

In Example 12, since the above resin mixture was only used in the first layer, while in the second and the third layers, use was made of a material good in solderability and relatively good in heat resistance, and in the third layer, use was made of a polyamide resin, the balance was good.

Since, in Example 13, the preliminary heating temperature was as low as 140° C., and in Example 14, preliminary heating was not carried out, the solderability was improved in each case.

In Example 15, since the coating thickness was as thick as 180 μm, it was observed that, conversely, the solderability was lowered a little.

In Example 16, the kneading temperature was 320° C., which was somewhat low, so the solderability was lowered a little.

In Examples 17 and 18, the conductor was a solderable enameled stranded wire, and the properties were as good as those of the case in which a solid bare wire was used.

However, since Comparative Example 1 used only a polyetherimide resin, and Comparative Example 2 used only a polyethersulfone resin in one layer, respectively, the heat resistance was high but solderability required was not exhibited.

Since Comparative Example 3 used only a polycarbonate resin, the heat resistance was little and the solderability was poor and was not on a practical level.

Further, since Comparative Example 4used only a fluororesin, the coilability was good, and similarly to Comparative Example 1, Comparative Example 4 was high in heat resistance but did not exhibit solderability required.

Comparative Example 5 was outside the range defined in the present invention. Since the amount of the resin to be blended was too small, Comparative Example 5 did not show solderability required, though the conductor was not preliminarily heated, and the heat resistance was good. Further, the appearance of the wire was poor.

Examples 19 to 21 and Comparative Example 6

Multilayer insulated wires were prepared in the same manner as in Example 3, except that, as shown in Table 2, for the resin mixtures of the first to third insulating layers (the parts of the compositions were parts by weight), the proportions of the polyethersulfone resin and the polycarbonate resin were changed.

In Comparative Example 6, a multilayer insulated wire was prepared, in which the first layer and the second layer were made of resin mixtures of polyethylene terephthalate and an ionomer, shown in Table 2, and the third layer was made of nylon 6,6.

These insulated wires were tested as described below. In this test, Heat Resistance Test (2) was included in the heat resistance evaluation because Heat Resistance Test (1) is effective only to judge whether the heat resistance is acceptable (passed) for Class B or Class E. Hear Resistance Test (2) was added for comparing the heat resistance by simplified evaluation method employed for enameled wires to test the heat resistance compared with that of a practically manufactured insulated wire (Comparative Example 6).

Heat resistance (2): The extrusion-coated insulated wire and a bare copper wire were twisted in accordance with JIS C 3003, the resultant twisted wire was heated at a temperature of 200° C. for 168 hours (7 days), and then the dielectric breakdown voltage was measured. It is indicated that the larger that value is, the higher the heat resistance is. When the ratio of the dielectric breakdown voltage after the deterioration to the dielectric breakdown voltage before the deterioration, namely, the residual rate (%) of the dielectric breakdown voltage after the deterioration, is 50% or more, it is considered that the extrusion-coated insulated wire satisfies Heat Resistance Class E of the IEC standards Pub. 172.

The tests of the solderability and the static friction coefficients were carried out in the same manner as in Example 3. The results are shown in Table 2.

TABLE 2

| | Example 19 | Example 3 | Example 20 | Example 21 | Comparative example 6 |
|---|---|---|---|---|---|
| First layer | PES:PC 100:20 | PES:PC 100:40 | PES:PC 100:60 | PES:PC 100:100 | PET:ionomer 100:15 |
| Second layer | PES:PC 100:20 | PES:PC 100:40 | PES:PC 100:60 | PES:PC 100:100 | PET:ionomer 100:15 |
| Third layer | PES:PC 100:20 | PES:PC 100:40 | PES:PC 100:60 | PES:PC 100:100 | Nylon 6,6 |
| Heat-resistance (2) (Residual ratio (%)) | 103 | 100 | 100 | 87 | 72 |
| Solderability (sec) | 5.0 | 4.0 | 3.0 | 3.0 | 1.0 |
| Static friction coefficient | 0.15 | 0.16 | 0.14 | 0.14 | 0.08 |
| Heat resistance (1)*1: | | | | | |
| Class B | 602 | 602 | 602 | x | x |
| Class E | 602 | 602 | 602 | 602 | 602 |

Note:
○: Passed x: Not passed

As is apparent from the comparison of the results of Examples 3 and 19 to 21 with the results of Comparative Example 6 (the practically employed wire wherein a nylon layer as an outermost layer covers two extrusion-coating layers of resin mixtures of a polyethylene terephthalate resin and an ionomer), the insulated wires of the present invention showed equal grade of solderability and coilability to those of the practically employed wire and, in addition, showed superior heat resistance.

Having described our invention as related to the present embodiments, it is our intention that the invention not be limited by any of the details of the description, unless otherwise specified, but rather be construed broadly within its spirit and scope as set out in the accompanying claims.

What we claim is:

1. A multilayer insulated wire comprising a conductor and solderable extrusion-insulating layers made up of two or more layers for covering the conductor, wherein at least one insulating layer is formed by a resin mixture comprising 100 parts by weight of a polyethersulfone resin, and 10 parts by weight or more of a resin (B), of at least one selected from polycarbonate resins, and polyarylate resins.

2. The multilayer insulated wire as claimed in claim 1, wherein the said resin (B) is a polycarbonate resin.

3. The multilayer insulated wire as claimed in claim 1, wherein the said polyethersulfone resin has a repeating unit represented by the following formula:

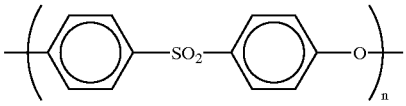

wherein n is a positive integer.

4. The multilayer insulated wire as claimed in claim 1, wherein the said resin mixture comprises 100 parts by weight of the polyethersulfone and 10 to 70 parts by weight of the resin (B).

5. The multilayer insulated wire as claimed in claim 1, wherein the said insulating layers are formed to cover the conductor with the conductor preheated to a temperature lower than 140° C. or not preheated.

6. A multilayer insulated wire comprising a conductor and solderable extrusion-insulating layers made up of two or more layers for covering the conductor, wherein at least one insulating layer is formed by a resin mixture comprising 100 parts by weight of a polyethersulfone resin, and 10 parts by weight or more of a resin (B), of at least one selected from polycarbonate resins and polyarylate resins, wherein the uppermost layer of the insulating layers is made of a polyamide resin.

7. A transformer using a multilayer insulated wire, wherein the multilayer insulated wire comprises a conductor and solderable extrusion-insulating layers made up of two or more layers for covering the conductor, and wherein at least one insulating layer is formed by a resin mixture comprising 100 parts by weight of a polyethersulfone resin, and 10 parts by weight or more of a resin (B), of at least one selected from polycarbonate resins, polyarylate resins and polyamide resins.

8. The transformer as claimed in claim 7, wherein the said resin (B) is a polycarbonate resin.

9. The transformer as claimed in claim 7, wherein the polyethersulfone resin has a repeating unit represented by the following formula:

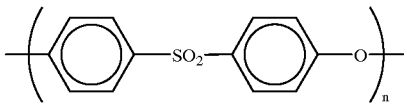

wherein n is a positive integer.

10. The transformer as claimed in claim 7, wherein the said resin mixture comprises 100 parts by weight of the polyethersulfone resin and 10 to 70 parts by weight of the resin (B).

11. The transformer as claimed in claim 7, wherein the said insulating layers are formed to cover the conductor with the conductor preheated to a temperature lower than 140° C. or not preheated.

12. The transformer as claimed in claim 7, wherein insulating layers other than the said at least one insulating layer are made of a thermoplastic polyester resin or a polyamide resin.

13. The transformer as claimed in claim 7, wherein the uppermost layer of the said insulating layers is made of a polyamide resin.

14. The multilayer insulated wire as claimed in claim 1, wherein the polycarbonate resins are represented by formula (3):

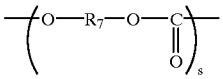

(3)

wherein $R_7$ represents a phenylene or a biphenylylene group:

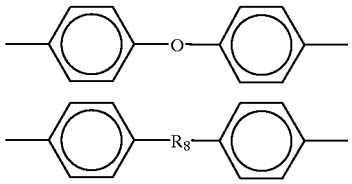

in which $R_8$ represents a substituted or unsubstituted alkylene group having 1 to 7 carbon atoms or a substituted or unsubstituted naphthylene group, and s is a positive integer.

* * * * *